US005602429A

United States Patent [19]

Scgiebelhuth

[11] Patent Number: 5,602,429

[45] Date of Patent: Feb. 11, 1997

[54] SAFETY SHUT-OFF DEVICE

[75] Inventor: Heinz Scgiebelhuth, Frankfurt, Germany

[73] Assignee: Braun Aktiengesellschaft, Kronberg, Germany

[21] Appl. No.: 417,925

[22] Filed: Apr. 6, 1995

[30] Foreign Application Priority Data

Apr. 9, 1994 [DE] Germany ..... 44 12 294.2

[51] Int. Cl.[6] ..... H01H 35/02

[52] U.S. Cl. ..... 307/121; 307/119; 200/56 A; 200/61.5; 200/61.52; 38/74; 340/429; 340/467; 219/240

[58] Field of Search ..... 307/121, 120, 307/119, 116, 112; 200/61.45 R, 61.52, 56 A, 61.42, 61.5, 61.71; 340/429, 467; 38/74; 219/240

[56] References Cited

U.S. PATENT DOCUMENTS

| | | | |
|---|---|---|---|
| 3,646,543 | 2/1972 | Morris | 340/262 |
| 3,879,703 | 4/1975 | Bonazoli et al. | 340/25 |
| 3,927,286 | 12/1975 | Fohl | 200/61.45 R |
| 4,686,352 | 8/1987 | Nawrot et al. | 219/250 |
| 4,980,575 | 12/1990 | Schenkel | 307/121 |
| 5,209,343 | 5/1993 | Romano et al. | 200/61.52 |
| 5,394,070 | 2/1995 | Jacobsen et al. | 318/568 |
| 5,410,115 | 10/1993 | Mielke | 200/61.45 |
| 5,473,322 | 7/1992 | Carney | 340/870.02 |

FOREIGN PATENT DOCUMENTS

| | | |
|---|---|---|
| 2638885 | 3/1978 | Germany . |
| 3921926 | 12/1990 | Germany . |
| 9017622 | 5/1991 | Germany . |
| 9103911 | 7/1991 | Germany . |
| 9200971 | 3/1992 | Spain . |

OTHER PUBLICATIONS

A copy of European Search Report dated Aug. 8, 1995.

*Primary Examiner*—William M. Shoop, Jr.
*Assistant Examiner*—Albert W. Paladini
*Attorney, Agent, or Firm*—Fish & Richardson, P.C.

[57] ABSTRACT

The invention is directed to a switch arrangement for signaling the movement and the inclination of the switch arrangement which is accommodated in a housing. The switch arrangement (2) includes a first switch (12) configured as an On/Off switch and a second switch (10) connected to a capacitor (K). The switches include each conductor portions (22, 24) adapted to be connected to each other by a movable actuating member (18). While the switch (12) signals both the movement and the inclination of the arrangement (2), the switch (10) signals a movement of the arrangement (2) by issuing pulse signals. In the position of the rest of the actuating member (18), none of the switches is activated. In one configuration of the switch arrangement, the actuating member is guided in a cutout whose sides extend towards each other in a converging fashion.

17 Claims, 4 Drawing Sheets

SAFETY SHUT-OFF DEVICE

SAFETY SHUT-OFF DEVICE

This invention relates to a switch arrangement for signaling the movement and the inclination of the switch arrangement. When the switch arrangement is moved or inclined, switches are activated by a movable actuating member. The term movement as used hereinafter is understood to mean a parallel displacement of the switch arrangement, whilst an inclination is construed to be a rotary motion about an axis.

From the state of the art switch arrangements are known by means of which movement and inclination of the arrangement are signaled. Spanish Utility Model No. U 92 00 971 describes such a switch arrangement in which a switch activated by a ball is arranged in a housing. Further, the switch arrangement represented in Utility Model No. U 92 00 971 has an inclined plane serving as the bottom wall. The switch signaling inclination and movement is associated with an upper end of the inclined plane towards which the ball travels as the switch arrangement experiences an inclination or a parallel displacement. In the position of rest, the ball rests on a lower section of the inclined plane spaced from the switch. As the switch arrangement is moved or inclined, the actuating member rolls over the two conductors of the switch, establishing contact.

It is a disadvantage in this arrangement that both states of motion, that is, the parallel displacement and the inclination, are signaled by a switch that is contacted by the ball only if it overcomes the inclined plane. As a result, the signaling action is not equally reliable in all directions of motion, functioning only on a comparatively high acceleration of the ball. To move the actuating member, different forces thus need to be expended in dependence on the direction of motion.

It is therefore an object of the present invention to provide a switch arrangement signaling a movement of the switch arrangement reliably also in the presence of a low acceleration and affording a straightforward construction.

This object is accomplished by a switch arrangement incorporating the characterizing features of claim 1. According to the present invention, a second switch connected to a capacitor rechargeable through a resistor forms a component part of the switch arrangement. In the following, the term switch is used either for a conductor having its first and second conductor portion connected to a respective electrical lead of its own, or for several conductors whose first and second conductor portions are connected to a common electrical lead.

This second switch operates such that, when the conductor portions of the switch are connected to each other by the movable actuating member as a result of movement, a switching pulse is reliably delivered through the capacitor connected to this switch. When the conductor portions of the switch are disconnected because the movable actuating member has traveled further, the capacitor is discharged, and a next sequential pulse is issued when the conductors are again connected by the actuating member.

By contrast, the first switch operates as an On/Off switch. If the conductors of the first switch are not connected to each other by the actuating member because the appliance is neither inclined nor moved, no switching signal is delivered. When the two conductors are temporarily connected by the actuating member because a movement occurs, the switch issues a short On/Off pulse. When the switch arrangement is inclined, the actuating member abuts against the conductors of the first switch, thus activating the switch. A lasting inclination of the switch arrangement is then signaled.

The provision of two switches whereof one is specifically designed to signal also extremely slow movements of the actuating member ensures that the switch arrangement signals a movement reliably also in the presence of a low acceleration.

The switch arrangement has a particularly high responsiveness, also in the presence of movements of a minimum acceleration.

If the switch arrangement of the present invention is utilized in combination with a counting device (referred to as a timer) or a safety shut-off device for a pressing iron, for example, a parallel displacement of the appliance—and thus of the switch arrangement—causes activation of at least the second switch, and on a more substantial movement also of the first switch, such activation occurring at short intervals due to the rolling motion of the ball as the appliance is being moved. The ball rolls because of the acceleration occurring during the movement. The first switch then issues switching pulses by turning On and Off, while the second switch, in combination with the capacitor, only issues switching pulses because on a lasting closed condition of the second switch, the capacitor reaches saturation, a fully charged capacitor preventing current from flowing through the second switch, the capacitor and the resistor. Activation and deactivation of the second switch in alternating sequence causes the capacitor to be charged and discharged. The switching pulses signal that the appliance is being moved. As a result, the safety shut-off device of the pressing iron is deactivated again and again. When the appliance is at rest, the ball is equally at rest, activating no switch. Accordingly, switching pulses which would deactivate the safety shut-off device of the iron are not issued, so that the appliance is turned off after a predetermined period of time. In the event that in such a position of rest the ball should accidentally close the second switch, the capacitor reaches saturation, maintaining its full charge. As a result, current ceases to flow through the capacitor, and the IC recognizes also this position as a "standstill" condition because any movement involves a flow of electricity. When the appliance is placed in a vertical position, this involves a movement beyond the predetermined angle of inclination, the ball then abutting continuously against the first switch. As long as the iron is in this position, the first switch is activated which operates on the safety shut-off device such that the appliance is turned off after a predetermined period of some length.

The bottom wall of the housing includes a first plane section which is adjoined by a second section which is inclined at a defined angle relative to the first section. In this arrangement, the second switch which signals a movement of the switch arrangement is associated with the first section, while the first switch which signals an inclination or a movement of the switch arrangement is associated with the second section.

The magnitude of the angle of inclination determines from which point on an inclination of the arrangement is signaled, because the first switch is located at the end of the second section remote from the first section. When the switch arrangement is inclined, the actuating member rolls in the direction of the second section. However, it will not roll up along the inclined second section until the arrangement is moved vigorously or is inclined past the angle of inclination. Accordingly, the first switch is not activated until the arrangement is inclined in excess of the angle of inclination or is moved vigorously, that is, at a high acceleration.

The second switch is located on the first section of the bottom wall in such a fashion that also a minor parallel displacement of the switch arrangement involving a minimum acceleration sets the actuating member in motion along the first section, thus causing contact to be established between the first and the second conductor portion or between the first and second conductor portions of the second switch, thus reliably signaling a minimum movement of the switch arrangement. With the appliance in the position of rest, none of the switches is activated.

Advantageously, in this embodiment the first and the second switch are each constructed of several conductors, with the first and the second conductor portions of the first and the second switch being each coupled to a common electrical lead. The conductors extend either vertically out of the bottom wall or are arranged in the bottom wall. This embodiment of the switch arrangement features particularly low cost because it utilizes components affording ready assembly.

A switch arrangement includes a bottom wall provided with a cutout. The cutout has a first section with parallel sides, and an adjoining second section whose sides extend in a converging fashion. While the second switch is arranged on the parallel sides of the first section, the first switch is arranged at the end of the second section remote from the first section.

The actuating member takes support upon the sides of the cutout. On a parallel displacement of the switch arrangement, the actuating member rolls along the sides of the first section. As this occurs, it activates the second switch which is preferably comprised of several conductors having each a first and a second conductor portion, with the first conductor portions engaging the one side and the second conductor portions engaging the opposite side. The actuating member establishes contact between the first conductor portions and the associated second conductor portions, and any movement of the switch arrangement is signaled by switching pulses issued by the capacitor. Owing to the use of several conductors, a high responsiveness is accomplished. In the presence of a slow movement, the actuating member remains in the first section of the bottom wall. It is only when a vigorous movement or an inclination of the switch arrangement occurs that the actuating member rolls into the section of the converging sides towards the first switch. The transition into the second section necessitates a lifting motion of the actuating member onto the converging sides of the cutout, which is only accomplished by a vigorous movement or an inclination of the arrangement. By appropriately selecting the amount of convergence, which is comparable to the selection of the angle of inclination, it can be determined from which inclination on the actuating member activates the first switch reliably. Again, the first switch is preferably constructed of a conductor having a first and a second conductor portion. A cutout in the bottom wall of the housing can be manufactured readily, enabling the housing and thus the entire switch arrangement to be built to minimum possible dimensions.

According to claim 15, the provision of a cutout with converging sides in the bottom wall of the housing is considered as involving an inventive step when taken alone, because also a switch arrangement known from the art and comprising only one switch configured as an On/Off switch can be activated by an actuating member movable within such a cutout. Starting from a mid-section with parallel sides, such a cutout may also include two end sections with converging sides.

Several conductors comprised of first and second conductor portions or, preferably, one conductor comprised of a first and a second conductor portion, engage the bottom wall of the switch arrangement, forming the second switch. The two conductor portions are of an elongate and raised configuration. Preferably, they have a round or approximately round cross-section. These two conductor portions which form the second switch are symmetrically arranged in respect of a common axis, their mid-sections being relatively spaced such a distance that the movable actuating member arranged between the conductor portions rests on the bottom wall in this section, preventing contact from being made between the conductor portions (rest position of the switch arrangement). Adjoining these mid-sections of the conductor portions are respective end sections. The end sections of two opposite conductor portions extend in a converging fashion as a result of which the actuating member, on being moved due to a parallel displacement towards the end sections of the conductor portions lying opposite each other more closely, takes support upon these conductor portions, thereby establishing a contact causing the second switch to signal a movement through the capacitor.

The first switch is arranged opposite a respective end section of the two conductor portions. As the switch arrangement is moved, movement of the actuating member out of the mid-section requires it to be lifted off the bottom wall, whereupon it rests on the two raised conductor portions of the second switch. However, it moves up to the first switch, that is, up to the end of the conductor portions, only on a vigorous movement or an inclination of the arrangement. The greater the grade of inclination of the arrangement, the farther the actuating member will roll towards an end section of the conductors. By means of the degree of convergence, an angle of inclination can be defined, and an inclination in excess of this angle is signaled reliably because the actuating member reliably abuts against the first switch at an inclination exceeding this angle.

The first switch is preferably comprised of two conductor portions being each provided with an electrical lead of its own. Preferably, a first conductor portion of the first switch extends vertically out of the bottom wall, and contact of the first switch signaling an inclined condition of the arrangement is established in that the actuating member connects the conductor portion extending vertically out of the bottom wall to one of the conductor portions engaging the bottom wall. In this switch arrangement, at least one of the conductor portions forming the second switch is contacted also on activation of the first switch.

This configuration of a switch arrangement affords particular ease of manufacture, responding reliably to parallel displacements at a minimum acceleration because the contact pressure of the actuating member on the two conductors of the second switch is at its maximum at the instant it is lifted clear of the bottom wall.

A ball is preferably used as the actuating member. A steel ball with a silvered surface has proven to be particularly suitable. The conductors are preferably fabricated with a gold-plated surface. In the use of such surface coatings, the switch arrangement resists aggressive environmental conditions particularly well, including, for example, acid vapors or high humidity and elevated temperatures.

The housing of the switch arrangement is conventionally mounted on a printed circuit board designed, for example, for the control of an appliance. In accordance with a preferred embodiment of the present invention, the printed circuit board is then configured as the bottom wall of the housing. This facilitates the structure and the assembly of the switch arrangement considerably.

A particularly simple control means for a counting device as, for example, the timer of a pressing iron, results by connecting the switch arrangement to the counting device such that the first and the second conductor portion of the first switch are each coupled to the counting device separately by means of a first and a second line, that the first conductor portion of the first switch is at the same time the first conductor portion of the second switch, and that the second conductor portion of the second switch is connected to the second line through a capacitor. This arrangement has the advantage that the switch arrangement requires only two outputs, that is, the first and the second line, in order to transmit the signals issued by the two switches.

In this configuration, a cut-off signal is advantageously generated for a pressing iron, for example, if the switch arrangement is immovable for a specified minimum period of time.

A second cutoff signal is generated if the switch arrangement is inclined at an angle exceeding a specified angle of inclination. In particular in a pressing iron the cutoff signal can then be generated after a period of time of some length when the iron is placed down in a vertical position and is not used during this lengthy period.

The switch arrangement of the present invention will be explained in greater detail in the following.

Figure 5:
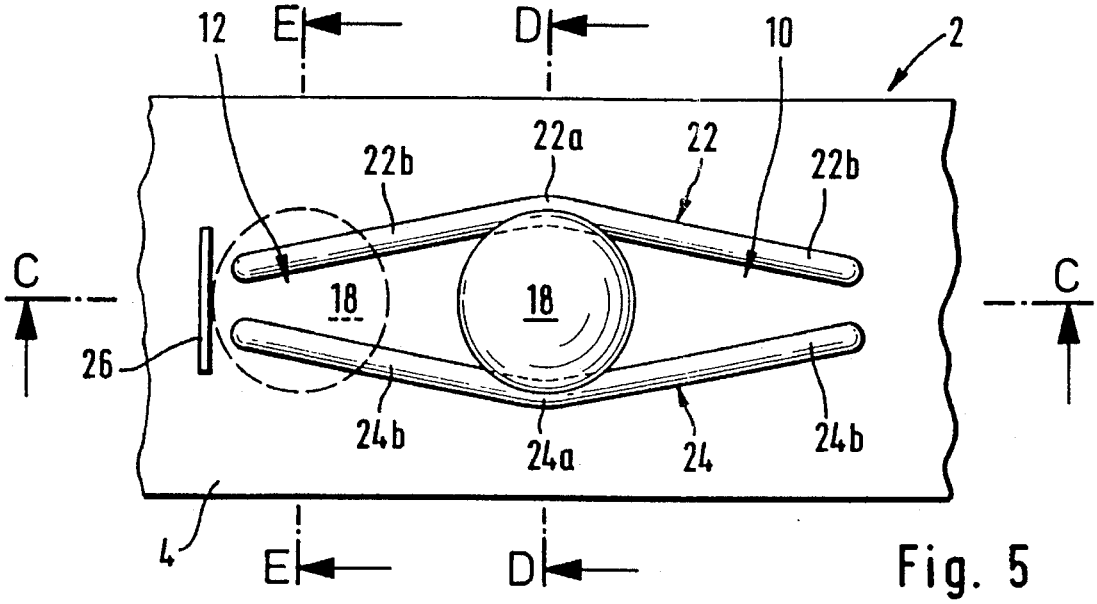
FIG. 5 is a top plan view of the switch arrangement illustrating a third embodiment.
Figure 7A:
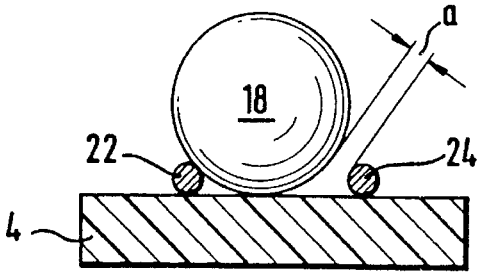
Figure 7B:
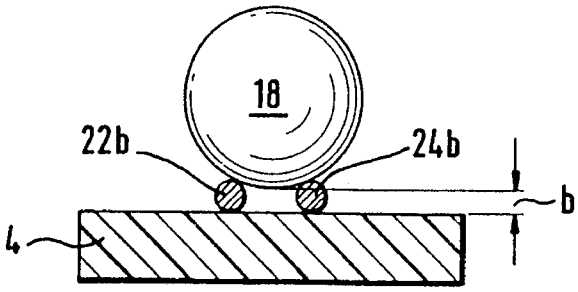
Figure 8:
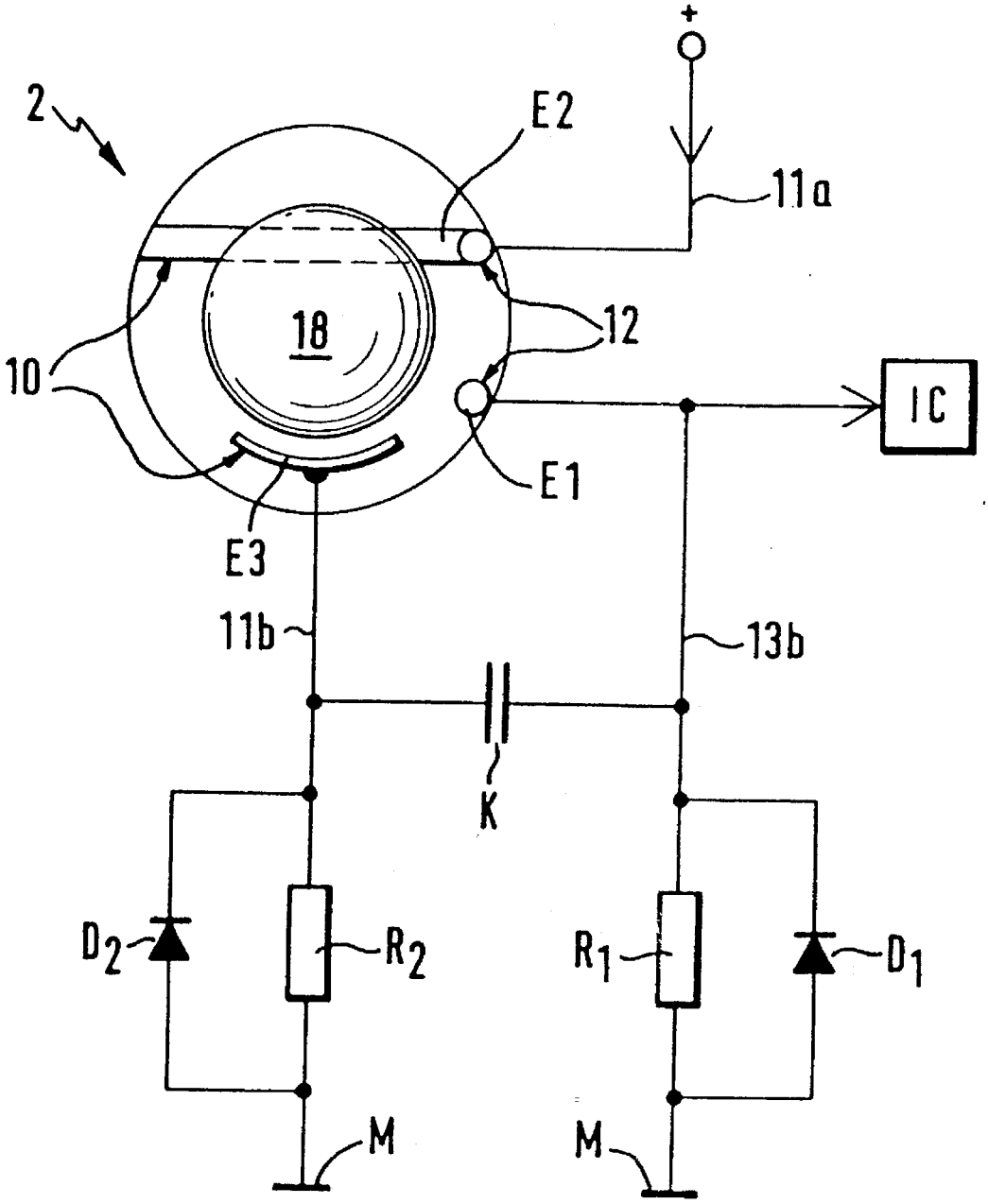

FIG. 7*a* is a sectional view of the switch arrangement taken along the line D—D of FIG. 5, but turned anticlockwise through 90 degrees;

FIG. 7*b* is a sectional view of the switch arrangement taken along the line E—E of FIG. 5, but turned anticlockwise through 90 degrees; and FIG. 8 is a schematic circuit diagram of the switch arrangement.

Figure 1:
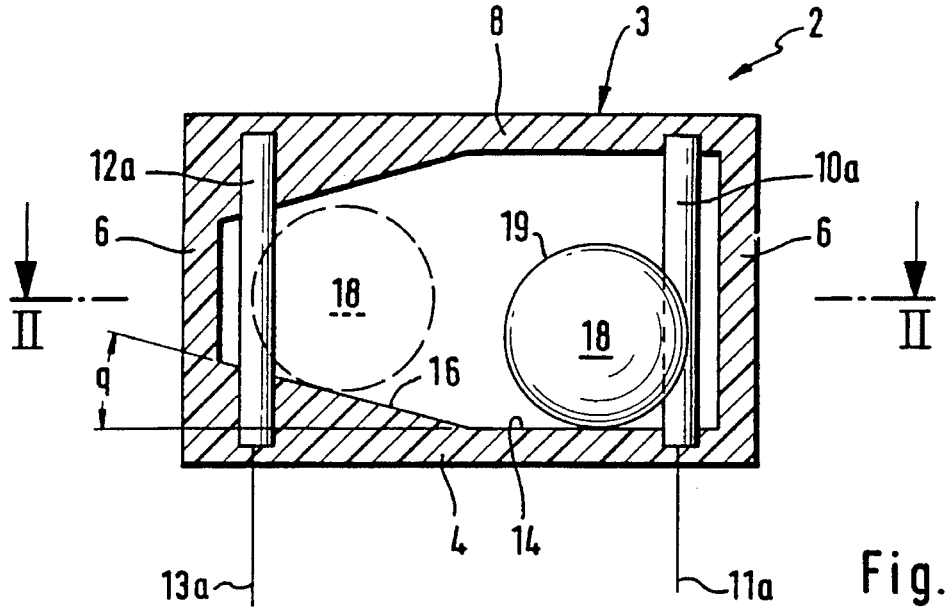
FIG. 1 is a sectional view of the switch arrangement of the present invention taken along the line A—A of FIG. 2, illustrating a first embodiment.
Figure 2:
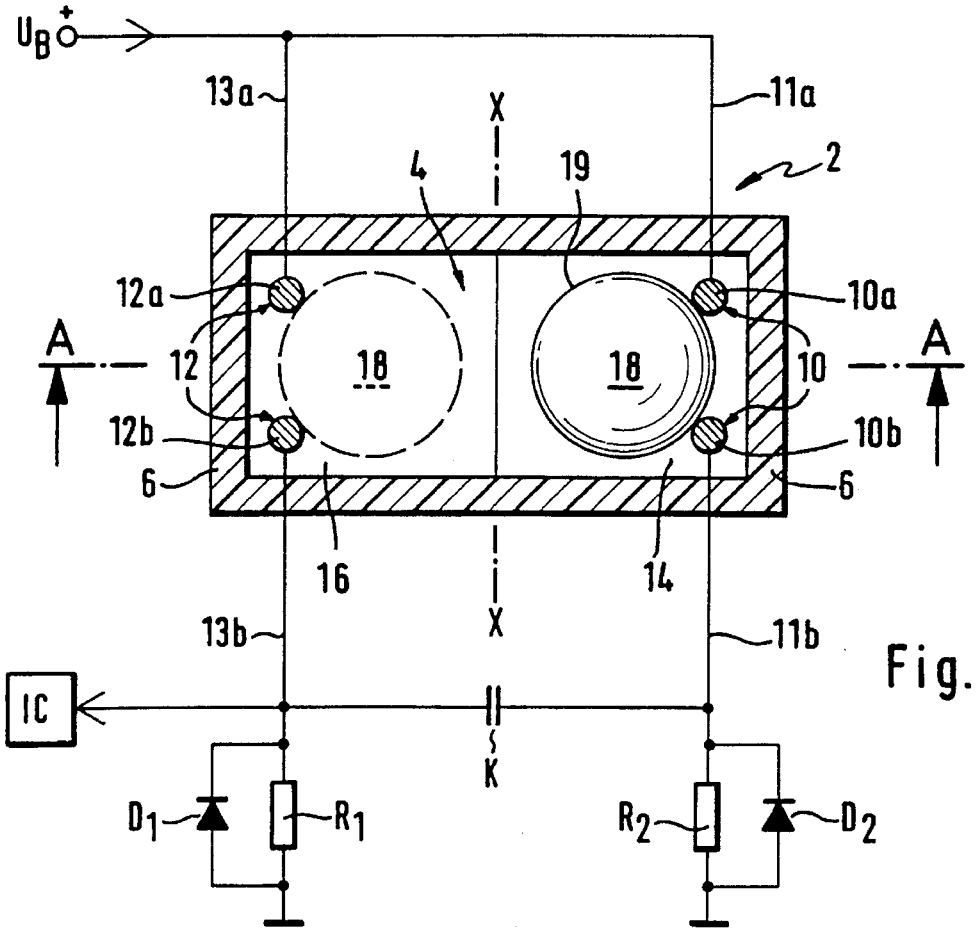
FIG. 2 is a transverse sectional view of the switch arrangement taken along the line II—II of FIG. 1.

In the following, a first embodiment of the switch arrangement 2 of the present invention will be explained with reference to FIGS. 1 and 2. FIGS. 1 and 2 illustrate a switch arrangement 2 accommodated in a housing 3 having a bottom wall 4, end walls 6 and an upper wall 8. The housing 3 is fabricated from an insulating material, preferably plastic. Inserted into the housing 3 are two pairs of conductor portions 10*a, b* and 12*a, b* pertaining each to a second and a first switch 10, 12, respectively. The conductor portions 10*a, b* and 12*a, b* extend from the bottom wall 4 to the upper wall 8 and are each connected to an electrical lead 11*a, b* and 13*a, b* of their own.

According to FIGS. 1 and 2, the bottom wall 4 has a first plane section 14 with an adjoining second section 16 inclined relative to the first section 14 at an angle q (FIG. 1). The second switch 10 is associated with the first plane section 14 of the bottom wall 4, while the first switch 12 is associated with the second inclined section 16 of the bottom wall 4. Traveling along the bottom wall 4 is a ball 18 which is held in the interior of the switch arrangement 2 by the end walls 6 and the upper wall 8. The top plan view of FIG. 2 shows the arrangement of the conductor portions 10*a, b* and 12*a, b* of the two switches 10 and 12, respectively. The axis X—X drawn in FIG. 2 denotes the axis about which the switch arrangement 2 is inclined when the first switch 12 is activated, as is the case in the FIGS. 1 and 2.

The ball 18 is silvered, thus having an electrically conductive surface establishing electrically conductive contact between the gold-plated conductor portions 10*a, b* and 12*a, b* of the respcctive switches 10 and 12 when two points on the ball surface abut against two conductor portions each. In the position of rest, that is, when the switch arrangement is neither inclined nor moved, the ball 18 lies on the first section 14 of the switch arrangement 2, actuating none of the two switches 10, 12. On a minor parallel displacement of the switch arrangement 2 to the left (and later to the right), which corresponds to the movements of a pressing iron during ironing, the ball 18 travels due to its gravity back and forth on the first section 14, activating in the process the second switch 10 at short intervals by establishing a contact between its conductor portions 10*a*, 10*b*. The conductor portion 10*b* of the second switch 10 is connected to the conductor portion 12*b* of the first switch 12 by means of a capacitor K which is charged through a resistor R1 when the switch 12 is closed. With the charge of the capacitor K increasing, the current decreases until it eventually reaches zero value with the capacitor fully charged. This applies only to the current through resistor R1. The current through resistor R2 continues to flow, but it is not recorded by the IC because of the blocking action of capacitor K. Also with the second switch 10 maintained closed, the IC accordingly records only a short current pulse. When the second switch 10 reopens, the capacitor discharges through resistors R2 and R1. Considering that the current flow during discharging of the capacitor K is in reverse direction as opposed to the current flow during charging of the capacitor K, the IC does not take notice of this current flow because its sign is reversed. To speed up discharging of the capacitor, a diode D1 may be connected in parallel with resistor R1. As the capacitor discharges, the resistor R1 is thereby short-circuited, while the diode is off during charging of the capacitor K through the second switch 10. After the capacitor K is discharged, reclosing of the second switch 10 enables the IC to record a current pulse. As a result of the alternation in opening and closing of the second switch 10, the IC is thus in a position to record a sequence of current pulses.

On a more vigorous movement, on an inclination of the switch arrangement 2 in a counterclockwise direction according to FIG. 1 or on an acceleration of the switch arrangement to the right (FIG. 1), the ball 18 travels in the direction of the second section 16 and then upwards along the second section 16. When the movement or the inclination has reached a sufficient degree, the ball 18 reaches the conductor portions 12*a* and 12*b* of the first switch 12, causing contact to be made. When the switch arrangement 2 is maintained in an inclined position exceeding the angle q, contact of the ball 18 with the switch 12 continues to be maintained. The switch 12 signals an inclination of the arrangement 2 by a continuous flow of current through resistor R1 when it is in the activated condition. When the switch 12 is closed only temporarily as a result of a vigorous movement, the IC records a current pulse. During the period of time the switch 12 is closed, the capacitor K is charged through the resistor R2. After the switch 12 is opened, the capacitor discharges through the resistors R1 and R2. Because of the direction of current flow, the IC records this discharge as an extension of the current pulse. The discharging operation can be speeded up by the diode D2 short-circuiting the resistor R1 during this discharge.

Figure 3:
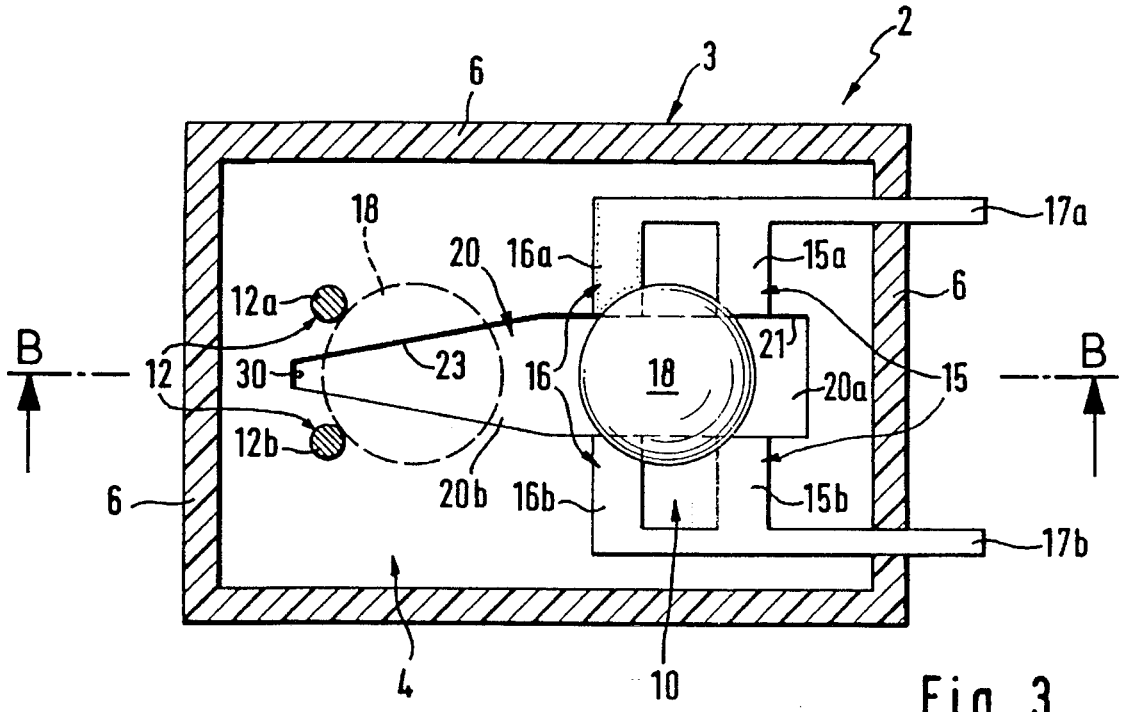
FIG. 3 is a top plan view of the switch arrangement illustrating a second embodiment.
Figure 4:
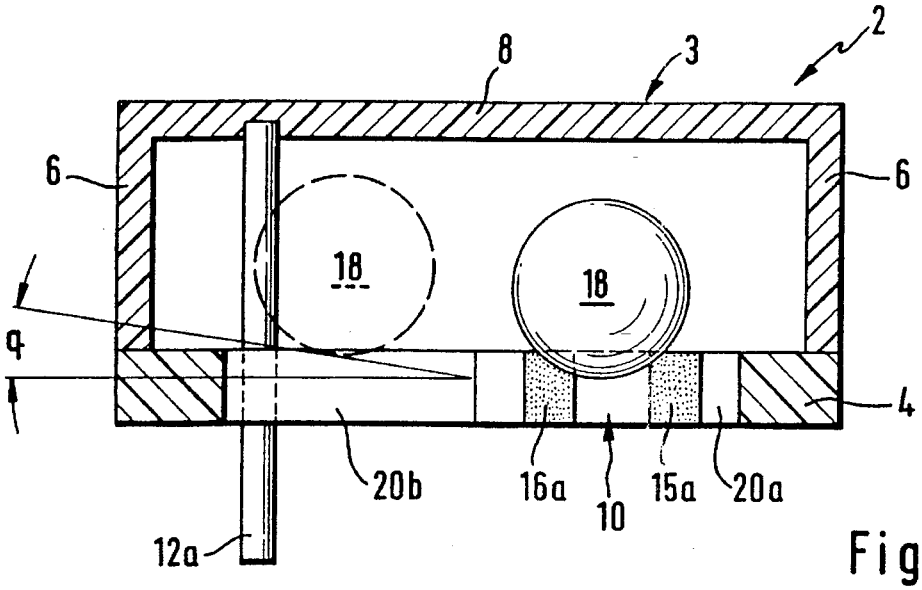
FIG. 4 is a sectional view of the switch arrangement taken along the line B—B of FIG. 3.

FIGS. 3 and 4 show a second embodiment of the switch arrangement 2. The bottom wall 4 of the housing 3 is provided with a cutout 20. The cutout 20 includes a first section 20*a* having parallel sides 21 and a second section 20*b* having converging sides 23. The first switch 12 is arranged at the end of the second section 20*b* where the relative distance of the sides 23 is at a minimum. This end is located on the side remote from the first section 20*a*. The first switch 12 is a conductor 12 comprised of two conductor portions 12*a*, 12*b* extending parallel to the end walls 6.

According to FIGS. 3 and 4, the second switch 10 is formed by several conductors 15, 16 extending transversely across the cutout section 20*a*. In this arrangement, the first and second conductor portions 15*a*, 16*a*; 15*b*, 16*b* are each connected to common leads 17*a*; 17*b*. When the switch arrangement 2 is moved, the ball 18 rolls back and forth in this section 20*a*, contacting as this occurs the conductor portions 15*a*, *b*; 16*a*, *b* of the conductors 15, 16 located on the opposed sides 21 of the cutout section 20*a*. As a result, the second switch 10 delivers switching pulses. When the switch arrangement 2, that is, the ball 18, is moved more vigorously, it travels into the cutout section 20*b*. As becomes apparent from FIG. 4, it is lifted in the process because the two sides 23 of the cutout section 20*b* are at a smaller relative distance towards the pointed end 30 than the sides of the cutout section 20*a*. When the switch arrangement 2 is inclined beyond the angle of inclination q which is determinable by the degree of convergence at which the two sides 23 of the cutout section 20*b* taper towards each other, the ball 18 abuts against the conductor portions 12*a*, *b*, activating the first switch 12 as indicated in FIG. 4 by the ball 18 shown in broken lines. The electric circuitry operates in the manner described with reference to FIG. 2. The fact that the second switch is comprised of several conductors has only the effect that switching pulses occur more frequently.

Figure 6:
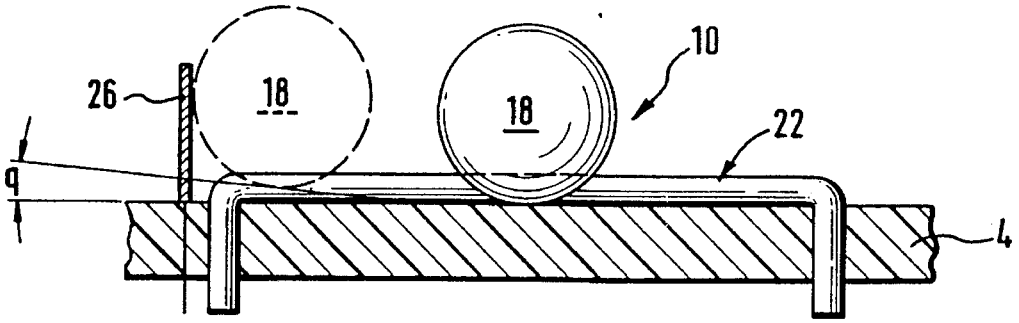
FIG. 6 is a sectional View of the switch arrangement taken along the line C—C of FIG. 5.

FIGS. 5 and 6 illustrate a third embodiment of the switch arrangement 2. Arranged on a bottom wall 4 are two round or approximately round gold-plated wires 22, 24 parallel and symmetrically to an axis C—C. The two wires 22, 24 form the two independent conductor portions of the second switch 10. The mid-sections 22*a*, 24*a* of the two wires are relatively spaced such a distance that the silvered ball 18 cannot establish contact between the wires when it is in the mid-position, that is, in its position of rest, as shown in FIG. 5. This position is illustrated in detail in FIG. 7*a* representing a section cut along the line D—D of FIG. 5. Even though the ball 18 abuts against one of the wire sections 22*a* or 24*a*, there still remains a gap a to the other wire section 24*a* or 22*a*. Starting from these mid-sections 22*a*, 24*a*, the sections 22*b*, 24*b* of the two wires extend in a converging fashion, that is, the distance to the common axis of symmetry C—C becomes progressively smaller in the direction of travel of the ball 18.

When the switch arrangement 2 is moved, the ball 18 of FIGS. 5 and 6 travels up the converging sections 22*b*, 24*b*, thus causing the second switch 10 to issue switching pulses which are delivered by capacitor K. This contact position can be seen in detail in FIG. 7*b* in which the ball 18 rests on the two wire sections 22*b*, 24*b* and is spaced from the bottom wall 4 by a distance b.

When the switch arrangement 2 is moved more vigorously or inclined, the ball 18 travels along the two wires 22, 24 up to the first switch 12 which is located at one end of the two wires 22, 24. The switch 12 as an On/Off switch is activated in that the ball 18 abuts against a metal plate 26 extending normal to the bottom wall and against one of the conductor portions 22 or 24 of the second switch 10. One of these two conductor portions 22, 24 of the second switch 10 forms at the same time a conductor portion of the first switch 12. The other conductor portion of the first switch 12 is formed by the metal plate 26. A corresponding schematic circuit diagram is illustrated in FIG. 8. As the switch arrangement 2 is inclined beyond the angle of inclination q, its activated position is, however, maintained.

FIG. 6 shows the lifting travel of the ball 18 when it rests on the sections 22*b*, 24*b* of the conductors of the second switch 10. In this embodiment of the switch arrangement 2, the angle of inclination q may be determined by different angles of convergence of the wires 22, 24.

FIG. 8 shows a schematic circuit diagram of the switch arrangement 2 in accordance with the third embodiment of FIGS. 5 and 6. Forming the second switch 10, the conductor portions E2 and E3 are arranged in the bottom wall 4, with the ball 18 traveling over them as the arrangement is moved. The conductor portions E1 and E2 form the first switch 12 signaling movement and inclination. According to FIGS. 2 and 8, the conductor portions E1 and E3 are connected to ground M through respective leads 13*b* and 11*b* including a respective resistor R1 and R2 which are connected to each other through a capacitor K inserted upstream from the resistors R1 and R2.

The conductor portion E2 is connected to a lead 11*a* connected to a terminal carrying positive voltage. This conductor portion E2 forms a component part of both the second switch 10 comprised of conductor portions E2 and E3, and the first switch 12 comprised of conductor portions E2 and E1. The line 13*b* between E1 and R2 goes to an input of an IC performing a time count, for example, a Telefunken timer U 2608. By inserting capacitor K, also the conductor portion E3 is connected to the same IC input through the lead 11*b*. If the two conductor portions E1 and E3 are dimensioned such as to preclude abutment of the ball 18 against them simultaneously, the mode of function of the circuitry is then identical to the mode of function according to FIG. 2. The conductor portion E3 corresponds to the conductor portion 10*b*, the conductor portion E1 corresponds to the conductor portion 12*b*, and the conductor portion E2 corresponds to the conductor portions 10*a* and 12*a*. If the conductor portions E1 and E3 are dimensioned such that it is possible for both the second switch 10 and the first switch 12 to be closed, the following mode of function results: When the ball 18 moves, the second switch 10 is closed first. As a result, the capacitor K is charged through the resistor R2. This is recorded by the IC by the occurring current pulse as described with reference to FIG. 2. If in addition the first switch 12 is closed, current flows through the resistor R2 as long as this first switch 12 is closed. In addition, the capacitor K is then discharged because the potential residing at its plates is the same if both the second and the first switch are closed. When the first switch 12 reopens, the second switch 10 initially remains closed, and the capacitor K is charged again. After the second switch 10 has also opened, the capacitor K discharges again. When the second and the first switch are again closed, this can be recorded again by the IC, as described.

If a switch arrangement 2 utilized, for example, in a pressing iron is connected to such a counter IC or a timer, the switch arrangement 2 signals any movement and inclination of an iron (not shown) or some other electrical appliance.

When the appliance is moved slowly, the ball 18 travels on the conductor portions of the second switch 10, causing this switch to deliver switching pulses through the capacitor K in rapid sequence. These switching pulses set the time counter IC of the timer back to "zero" (referred to as reset). After each reset, the counter IC starts a new count. When the count reaches a predetermined final value of, for example, 30 seconds because no further switching pulses are received, this is due to the fact the appliance is not being moved. To avoid scorching of the article being ironed and fires, the iron is shut off in that a first cutoff signal is generated.

The first switch 12 signals equally a movement of the pressing iron by a brief "contact kiss" of the conductor portions E1, E2. However, as described in the foregoing, this "contact kiss" occurs only on a comparatively vigorous movement. When the appliance is not moved, the first switch 10 remains deactivated. When the appliance is inclined at an angle in .excess of the angle of inclination q, the ball 18 abuts against the first switch 12, activating it. With the switch 12 activated, the counter IC of the timer is not reset, yet the appliance is not shut off either after 30 seconds have elapsed. Rather, it is assumed that the user has placed the appliance down. With the first switch 12 activated, the iron is therefore shut off only after a period of time of some length which may be six or eight minutes, for example, because the predetermined angle of inclination q is typically exceeded at the instant of time when the iron is placed down in a vertical position. In this case, therefore, a second cutoff signal is generated.

I claim:

1. A pressing iron including a sensing assembly for signaling when the pressing iron is in use, said sensing assembly comprising:

an inclination sensor including a movable actuating member, and a displacement sensor sharing said movable actuating member with said inclination sensor, wherein said movable actuating member moves in response to an inclination of the pressing iron thereby causing the inclination sensor to detect when the pressing iron has been inclined at an angle at least equal to a predetermined angle relative to a horizontal plane, and moves in response to an acceleration of the pressing iron associated with an ironing motion of the pressing iron thereby causing the displacement sensor to detect when the pressing iron is in use.

2. The pressing iron of claim 1 wherein said inclination sensor is further constructed and arranged to signal a displacement of said movable actuating member at an acceleration greater than the acceleration associated with the ironing motion of the pressing iron.

3. The pressing iron of claim 1 wherein said inclination sensor comprises a first conductor portion and a second conductor portion, activation of said inclination sensor occurring when said actuating member is in contact with both conductor portions.

4. The pressing iron of claim 1 wherein said displacement sensor comprises a first conductor portion and a second conductor portion, activation of said displacement sensor occurring when said actuating member is in contact with both conductor portions.

5. The pressing iron of claim 1 further comprising a base along which said actuating member moves, said base defining a first section oriented substantially parallel to an ironing surface of said iron and a second section adjoining the first section and inclined at said predetermined angle relative to said first section, said displacement sensor being associated with said first section and said inclination sensor being associated with said second section.

6. The pressing iron of claim 1 further comprising a base defining a aperture having a first section with parallel sides and an adjoining second section with sides extending in a converging fashion, said actuating member being supported for movement along said sides of said first section and said sides of said second section, said displacement sensor being associated with the parallel sides of the first section and said inclination sensor being arranged at an end of the second section remote from the first section.

7. The pressing iron of claim 6 wherein each side of said parallel sides of said first section comprises a conductor portion, activation of said displacement sensor occurring when said actuating member is in contact with both conductor portions.

8. The pressing iron of claim 7 wherein said displacement sensor comprises two conductors having first conductor portions connected to a first common electrical lead and second conductor portions connected to a second common electrical lead.

9. The pressing iron of claim 6 wherein said inclination switch comprises first and second conductor portions arranged at an end of the second section remote from the first section, activation of said inclination sensor occurring when said actuating member is in contact with both conductor portions.

10. The pressing iron of claim 1 wherein said displacement sensor comprises a first conductor portion and a second conductor portion symmetrically arranged about an axis, said first and said second conductor portions defining a mid-section and first and second end sections, said first and second conductor portions being spaced such that the actuating member, upon displacement from said mid-section into one of said end sections, contacts the first and the second conductor portions signaling movement of the pressing iron.

11. The pressing iron of claim 10 further comprising a first conductor element arranged opposite one of said end sections, at least one of said first and second conductor portions comprising a second conductor element, activation of said inclination sensor occurring when said actuating member is in contact with both conductor elements.

12. The pressing iron of claim 1 wherein said movable actuating member comprises a spherical body.

13. The pressing iron of claim 1 further comprising a printed circuit board, said sensing assembly being mounted on said printed circuit board.

14. The pressing iron of claim 1 further comprising a capacitor rechargeable through a resistor, said capacitor being connected to said displacement sensor.

15. The pressing iron of claim 1 further comprising a time counting device connected to said sensing assembly, said sensing assembly including a first conductor portion coupled to the time counting device by a first line and a second conductor portion coupled to the time counting device by a second line, said sensing assembly further including a capacitor and a third conductor portion connected to said first line through said capacitor such that said first conductor portion and said third conductor portion are jointly connected to the time counting device through said first line, the time counting device being reset when a current pulse is recorded.

16. The pressing iron of claim 15 wherein the time counting device generates a first cutoff signal when the count reaches a predetermined minimum period of time.

17. The pressing iron of claim 16 wherein the time counting device generates a second cutoff signal when current flows during a predetermined minimum period of time.

* * * * *

UNITED STATES PATENT AND TRADEMARK OFFICE

CERTIFICATE OF CORRECTION

PATENT NO. : 5,602,429

DATED : February 11, 1997

INVENTOR(S) : Heinz Schiebelhuth

It is certified that error appears in the above-indentified patent and that said Letters Patent is hereby corrected as shown below:

Title Page, Col. 1, under [19], "Scgiebelhuth" should be --Schiebelhuth--;

Title Page, Col. 1, [75] Inventor "Heinz Scgiebelhuth" should be --Heinz Schiebelhuth--;

Title Page, Col. 2, [57] Abstract:
line 4, delete "(2)" and "(12)"
line 5, delete "(10)";
line 6, delete "(K)";
line 7, delete "(22, 24)";
line 8, delete "(18)" and "(12)";
line 10, delete "(2)" and "(10)";
line 11, delete "(2)";
line 12, delete "(18)";

Col. 5, line 20, after "inclination" insert --q--;

Col. 5, line 40, "View" should be --view--;

Signed and Sealed this

Third Day of November, 1998

*Attest:*

Bruce Lehman

BRUCE LEHMAN

*Attesting Officer*

*Commissioner of Patents and Trademarks*